US009555532B2

(12) United States Patent
Amend et al.

(10) Patent No.: US 9,555,532 B2
(45) Date of Patent: Jan. 31, 2017

(54) ROTARY IMPACT TOOL

(71) Applicant: Ingersoll-Rand Company, Davidson, NC (US)

(72) Inventors: Ryan Scott Amend, Bethlehem Township, PA (US); Edward Charles Eardley, Easton, PA (US); Timothy Richard Cooper, Titusville, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 725 days.

(21) Appl. No.: 13/932,415

(22) Filed: Jul. 1, 2013

(65) Prior Publication Data

US 2015/0000946 A1 Jan. 1, 2015

(51) Int. Cl.

| | |
|---|---|
| ***B25B 19/00*** | (2006.01) |
| ***B25D 11/04*** | (2006.01) |
| ***B25B 21/02*** | (2006.01) |

(52) U.S. Cl.

CPC ..... *B25D 11/04* (2013.01); *B25B 21/026* (2013.01); *Y10T 74/1836* (2015.01)

(58) Field of Classification Search

CPC ..... B25B 21/026; B25B 21/02; B25B 29/006; B25B 19/00; Y10T 74/1836; B25D 11/04; B23P 19/06; B60B 29/006

USPC ..... 173/93, 93.6

See application file for complete search history.

(56) References Cited

U.S. PATENT DOCUMENTS 2,268,412 A * 12/1941 McCombs ..... B25D 11/102 173/93.6
2,881,885 A * 4/1959 Stanford ..... B25B 21/026 173/93.6
2,886,997 A * 5/1959 Madsen ..... B25B 21/026 173/169
3,072,232 A * 1/1963 Martin ..... B25B 21/026 173/93.5
3,144,108 A * 8/1964 Reynolds ..... B25B 21/026 173/93.5
3,198,303 A * 8/1965 Brown ..... B25B 21/026 173/93
3,223,210 A * 12/1965 Schweizer ..... B25B 23/1453 173/93.6

(Continued)

FOREIGN PATENT DOCUMENTS

CN 2732428 10/2005
CN 2902605 5/2007

(Continued)

OTHER PUBLICATIONS

Chinese Office Action; Chinese Application No. 201410212538.9, Sep. 6, 2015, 5 pages.

*Primary Examiner* — Hemant M Desai
*Assistant Examiner* — Lucas Palmer
(74) *Attorney, Agent, or Firm* — Barnes & Thornburg LLP

(57) ABSTRACT

In at least one illustrative embodiment, a rotary impact tool may include an anvil and at least one hammer configured to impact the anvil to cause the anvil to rotate. The anvil may include an output shaft, a first lug extending outward in a radial direction from the output shaft and extending a first distance around the output shaft in a circumferential direction, and a second lug extending outward in the radial direction from the output shaft and extending a second distance, different from the first distance, around the output shaft in the circumferential direction.

11 Claims, 4 Drawing Sheets

(56) References Cited

U.S. PATENT DOCUMENTS 3,228,486 A * 1/1966 Kaman ..... B25B 21/02 173/93.6
3,557,884 A * 1/1971 Allen ..... B25B 21/02 173/93.5
3,661,217 A * 5/1972 Maurer ..... B25B 21/026 173/93.5
4,287,956 A * 9/1981 Maurer ..... B25B 21/026 173/93.5
4,321,973 A 3/1982 Maurer
4,991,472 A 2/1991 Hollingsworth
5,083,619 A 1/1992 Giardino et al.
5,906,244 A * 5/1999 Thompson ..... B25B 21/026 173/93.5
6,003,618 A 12/1999 Wallace
6,070,674 A * 6/2000 Williamson ..... B25B 21/026 173/1
6,202,763 B1 3/2001 Gude et al.
6,446,735 B1 9/2002 Chen
6,491,111 B1 * 12/2002 Livingston ..... B25B 21/02 173/93
7,077,348 B2 7/2006 Johnson et al.
7,147,063 B2 * 12/2006 Chen ..... B25B 21/026 173/93
7,165,631 B2 * 1/2007 Chang ..... B25B 21/02 173/104
7,510,023 B1 * 3/2009 Cheng ..... B25B 21/02 173/93
7,562,720 B2 * 7/2009 Seith ..... B25B 21/026 173/176
8,020,630 B2 9/2011 Amend et al.
8,505,648 B2 * 8/2013 Elger ..... 173/93
2003/0024714 A1 * 2/2003 Liao ..... B25B 21/026 173/93.5
2004/0149469 A1 * 8/2004 Colangelo, III ..... B25B 21/026 173/93.5
2006/0032646 A1 * 2/2006 Chang ..... B25B 21/026 173/93.5
2006/0157261 A1 7/2006 Chen
2006/0225903 A1 10/2006 Sterling et al.
2007/0289760 A1 12/2007 Sterling et al.
2008/0164041 A1 7/2008 Hess et al.
2009/0014193 A1 1/2009 Barezzani et al.
2010/0300716 A1 * 12/2010 Amend ..... B25B 21/026 173/93
2011/0048751 A1 * 3/2011 Elger ..... B25B 21/026 173/93.5
2012/0292065 A1 * 11/2012 Hoshi ..... B25B 21/02 173/93
2013/0112449 A1 * 5/2013 Lu ..... B25B 21/026 173/126
2014/0069674 A1 * 3/2014 Tsai ..... B25B 21/026 173/93
2014/0158388 A1 * 6/2014 Johnson ..... B25B 21/026 173/1

FOREIGN PATENT DOCUMENTS

CN 101683730 3/2010
DE 102005046311 A1 * 3/2007 ..... B25B 21/02
EP 1174222 1/2002
TW EP 2799186 A1 * 11/2014 ..... B25B 21/004
WO WO 2004033155 A2 * 4/2004 ..... B25B 21/02

* cited by examiner

ROTARY IMPACT TOOL

TECHNICAL FIELD

The present disclosure relates to rotary tools that include an impact mechanism, such as impact drivers, impact wrenches, and the like.

BACKGROUND

Rotary impact tools are used to tighten or loosen fasteners. Rotary impact tools often include a drive motor with a motor shaft, a hammer driven by the motor shaft, and an anvil that is impacted by the hammer so that the anvil is rotated and thereby drives a fastener. Most impact mechanisms are configured to transmit high-torque rotational force to the anvil (and subsequently a fastener) while requiring relatively low-torque reaction forces be absorbed by the motor and/or an operator holding the rotary impact tool. More specifically, by using the motor to repeatedly accelerate the hammer while it is out of contact with the anvil and then bringing the hammer only briefly into contact with the anvil, the anvil is imparted with a high-torque rotational force from the impacts of the hammer, while the motor's stator is exposed only to low-torque reaction forces corresponding generally to the free acceleration of the hammer.

SUMMARY

According to one aspect, a rotary impact tool may comprise a motor including a rotor and an input shaft coupled to the rotor for rotation therewith about an input axis, an anvil configured to be rotated about an output axis, the anvil including an output shaft, a first lug extending outward in a radial direction from the output shaft and extending a first distance around the output shaft in a circumferential direction, and a second lug extending outward in the radial direction from the output shaft and extending a second distance different from the first distance around the output shaft in the circumferential direction, and a first hammer driven by the input shaft and configured to impact the anvil to cause the anvil to rotate about the output axis.

In some embodiments, the input shaft axis and the output shaft axis may be collinear. In other embodiments, the input shaft axis and the output shaft axis may be non-parallel.

In some embodiments, the output shaft may have a proximal end and a distal end spaced apart from the proximal end, the distal end being adapted to be coupled to a fastener driver, and the first lug may be spaced further from the proximal end than the second lug. The second lug may extend further around the output shaft in the circumferential direction than the first lug. The first lug may be spaced apart from the second lug around the output shaft in the circumferential direction. The first lug may be arranged circumferentially opposite the second lug around the output shaft. The first lug and the second lug may extend substantially the same distance along the output axis.

In some embodiments, the rotary impact tool may further comprise a second hammer driven by the input shaft and configured to impact the anvil to cause the anvil to rotate about the output axis. The first hammer may extend around the output shaft and the first lug, and the second hammer may extend around the output shaft and the second lug. The rotary impact tool may further comprise a carrier coupled to the input shaft for rotation therewith, wherein the first hammer is coupled to the carrier for rotation relative to the carrier about a first hammer axis spaced apart from the output axis and the second hammer is coupled to the carrier for rotation relative to the carrier about a second hammer axis spaced apart from the output axis and the first hammer axis.

According to another aspect, a drive train may comprise an input shaft rotatable about an input axis, an anvil configured to rotate about an output axis, the anvil including an output shaft, a first lug extending a first distance around the output shaft through a first angle, and a second lug extending a second distance around the output shaft through a second angle different from the first angle, and a first hammer extending around the anvil and configured to be driven by the input shaft to impact at least one of the first lug and the second lug to drive rotation of the anvil about the output axis.

In some embodiments, the second lug may be closer to the input shaft than the first lug, and the second angle may be greater than the first angle. The first lug may be arranged circumferentially opposite the second lug around the output shaft. The first lug and the second lug may have substantially the same axial length along the output axis.

In some embodiments, the drive train may further comprise a second hammer, wherein the first hammer extends around the output shaft and the first lug and the second hammer extends around the output shaft and the second lug. The drive train may further comprise a carrier coupled to the input shaft for rotation therewith about the input axis, wherein the first hammer is coupled to the carrier for rotation therewith about the input axis and the second hammer is coupled to the carrier for rotation therewith about the input axis. The first hammer may be coupled to the carrier for rotation relative to the carrier about a first hammer axis spaced apart from the input axis, and the second hammer may be coupled to the carrier for rotation relative to the carrier about a second hammer axis spaced apart from the input axis and the first hammer axis.

According to yet another aspect, a drive train may comprise an input shaft rotatable about an input axis, an anvil configured to rotate about an output axis, the anvil including an output shaft, a first lug extending outward in a radial direction from the output shaft, and a second lug extending outward in the radial direction from the output shaft, and an impactor including a first hammer configured to impact the first lug to drive rotation of the anvil about the output axis and a second hammer configured to impact the second lug to drive rotation of the anvil about the output axis. The first hammer may include an outer ring and a pair of impact jaws extending inwardly in the radial direction from the outer ring, the second hammer may include an outer ring and a pair of impact jaws extending inwardly in the radial direction from the outer ring, the pair of impact jaws of the first hammer may be spaced a first distance apart around the outer ring of the first hammer, and the pair of impact jaws of the second hammer may be spaced a second distance apart around the outer ring of the second hammer different from the first distance.

In some embodiments, the output shaft may have a proximal end and a distal end adapted to be coupled to a fastener driver, the first lug may be spaced further from the proximal end than the second lug, and the first distance may be smaller than the second distance. The impactor may include a carrier coupled to the input shaft for rotation therewith about the input axis, the first hammer may be coupled to the carrier for rotation relative thereto about a first hammer axis, and the second hammer may be coupled to the carrier for rotation relative thereto about a second hammer axis.

BRIEF DESCRIPTION OF THE DRAWINGS

The concepts described in the present disclosure are illustrated by way of example and not by way of limitation in the accompanying drawings. For simplicity and clarity of illustration, elements illustrated in the drawings are not necessarily drawn to scale. For example, the dimensions of some elements may be exaggerated relative to other elements for clarity. Further, where considered appropriate, reference labels have been repeated among the drawings to indicate corresponding or analogous elements.

DETAILED DESCRIPTION OF THE DRAWINGS

Figure 1:
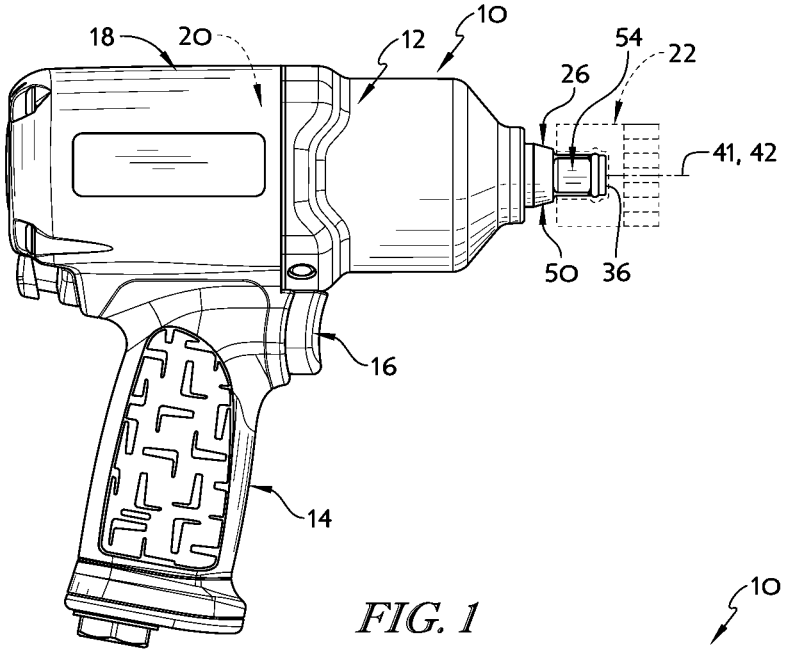
FIG. 1 is a side elevation view of one illustrative embodiment of an impact tool.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

One illustrative embodiment of an impact tool 10 that may be used to drive a fastener is shown in FIG. 1. In this illustrative embodiment, the impact tool 10 includes a casing 12 including a body 18 and a handle 14 extending from the body 18. A trigger 16 is coupled to the handle 14 to move relative to the handle 14. The body 18 houses a drive train 20 configured to rotate a socket 22 (shown in phantom) which in turn tightens or loosens a fastener, such as a bolt, a nut, a screw, or the like. The drive train 20 is activated by a user pressing the trigger 16.

Figure 2:
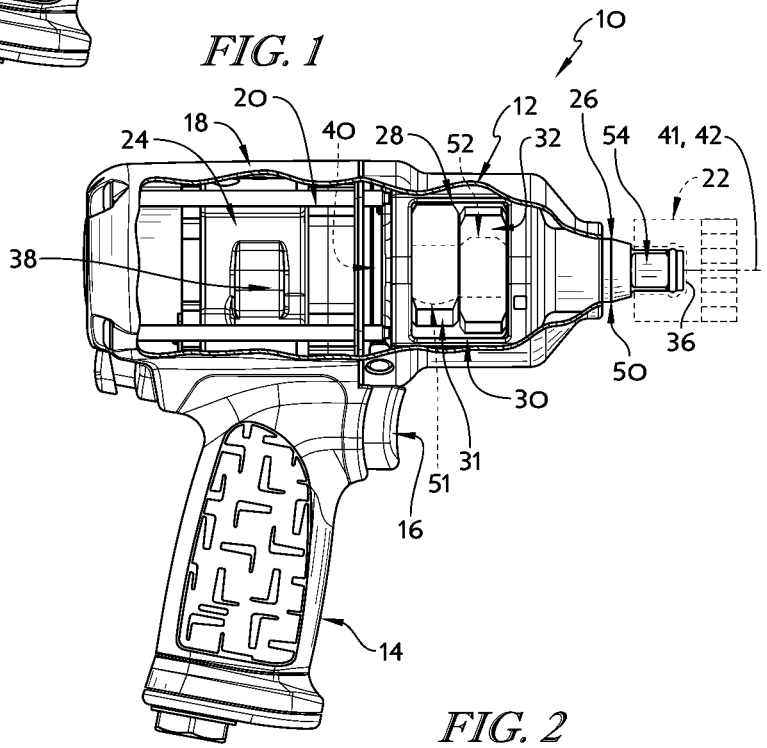
FIG. 2 is a cutaway side view of the impact tool of FIG. 1, showing a drive train of the impact tool.

Turning to FIG. 2, a portion of the casing 12 is broken away to show the drive train 20. In the illustrative embodiment, the drive train 20 includes a motor 24, an anvil 26, and an impactor 28 having two hammers 31, 32 that impart repeated blows onto the anvil 26 to cause the anvil 26 to rotate. The motor 24 is illustratively embodied as an air motor but, in other embodiments, may be an electric motor powered by a battery or a wired electrical connection. The impactor 28 is illustratively rotated by the motor 24, causing the hammers 31, 32 of the impactor 28 to strike the anvil 26 as the impactor 28 is rotated. The anvil 26 has a proximal end 34 arranged near the impactor 28 and a distal end 36 configured to be mated with a fastener driver, such as the socket 22 (shown in phantom).

The motor 24 includes a rotor 38 and a motor shaft 40, as shown in FIG. 2. The rotor 38 is coupled to and drives rotation of the motor shaft 40 about a motor axis 41. The motor shaft 40 is coupled to the impactor 28 of the drive train 20 and rotates the impactor 28 about an output axis 42. In the illustrative embodiment, the motor axis 41 and the output axis 42 are collinear. In other embodiments, the motor axis 41 and the output axis 42 may be parallel but spaced apart from one another. In still other embodiments, the motor axis 41 and the output axis 42 may be non-parallel. It will be appreciated that, while the motor shaft 40 is illustratively shown as being directly coupled to the impactor 28, any number of components (e.g., gearing) may be disposed between the motor shaft 40 and impactor 28.

Figure 3:
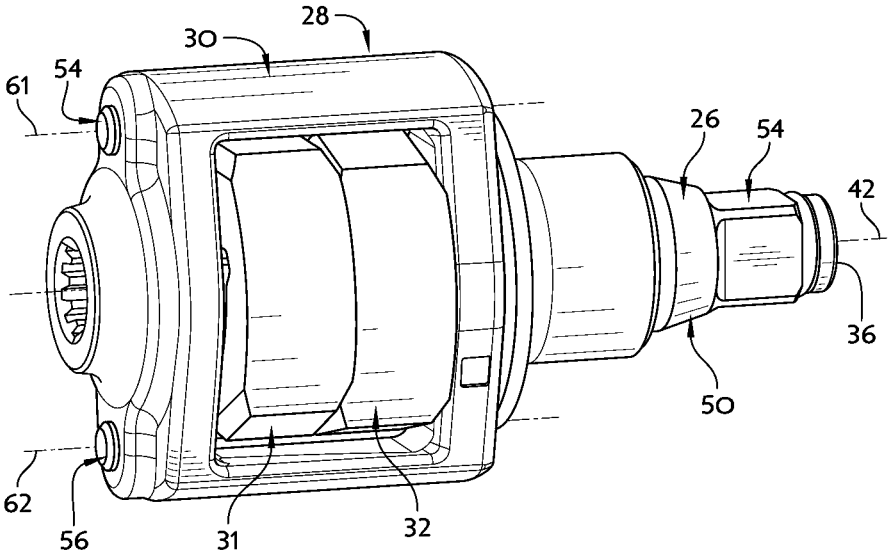
FIG. 3 is a perspective view of an anvil, a carrier, and two hammers of the drive train of FIG. 2.
Figure 4:
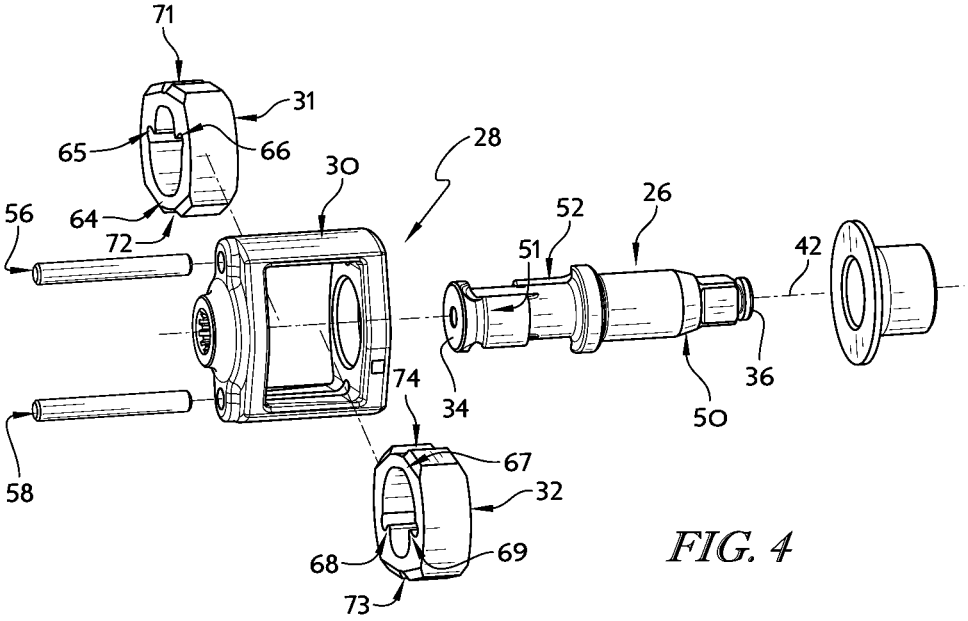
FIG. 4 is an exploded view of the anvil, the carrier, and the two hammers of FIG. 3.
Figure 5:
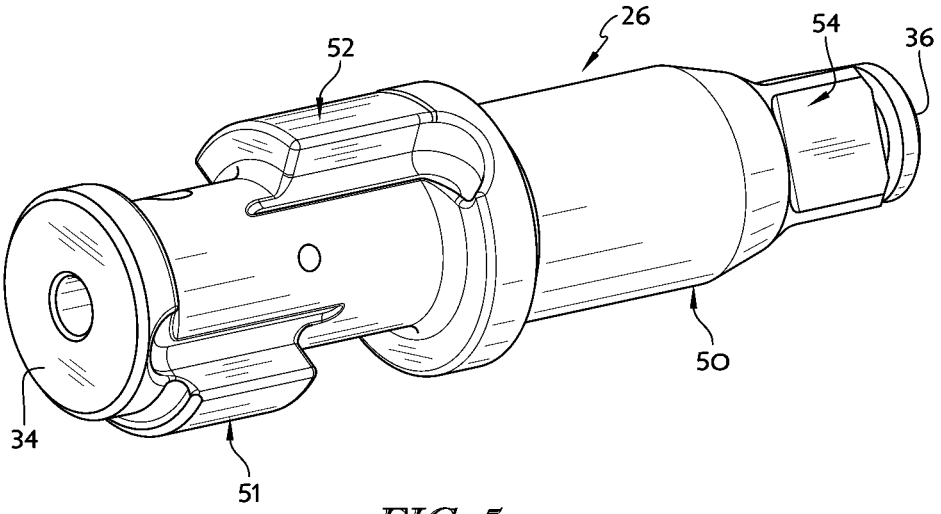
FIG. 5 is a perspective view of the anvil of FIGS. 3 and 4.
Figure 6:
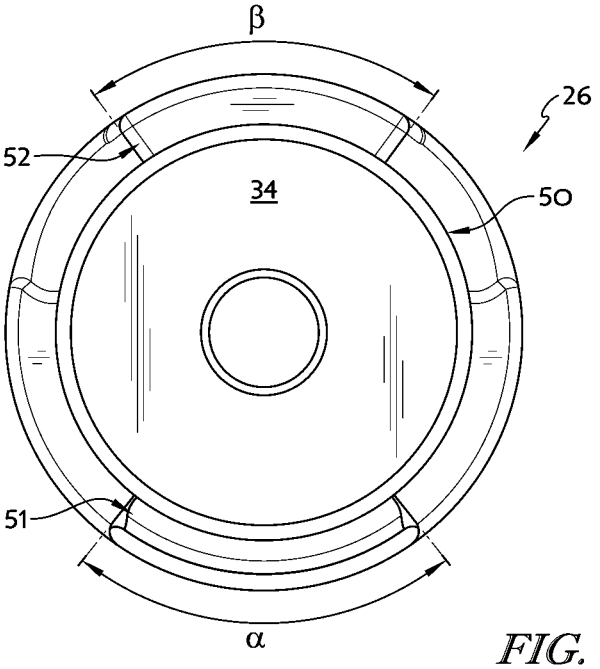
FIG. 6 is an aft end view of the anvil of FIG. 3-5.
Figure 7:
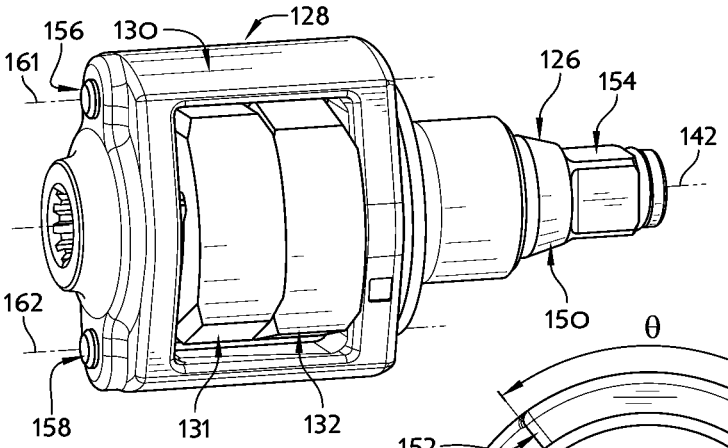
FIG. 7 is a perspective view of another illustrative embodiment of an anvil, a carrier, and two hammers (specifically, an aft hammer and a forward hammer) that may be used in the drive train of FIG. 2.

Referring now to FIGS. 3-6, the anvil 26 extends through a portion of the impactor 28 and is illustratively embodied as a monolithically formed component. The anvil 26 includes an output shaft 50, an aft lug 51, and a forward lug 52, as shown in FIGS. 4-6. The output shaft 50 is mounted for rotation about the output axis 42 and is formed to include a connector 54 located at the distal end 36 of the anvil 26 that is adapted to couple to a fastener driver, such as the socket 22 (shown in phantom in FIGS. 1 and 2). The aft lug 51 is located near the proximal end 34 of the anvil 26, as shown in FIGS. 4 and 5. The forward lug 52 is located between the aft lug 51 and the distal end 36 of the anvil 26.

In the illustrative embodiment, each lug 51, 52 of the anvil 26 extends outward in a radial direction from the output shaft 50, as shown in FIGS. 4-6. Additionally, each lug 51, 52 of the anvil 26 extends a similar distance along the output shaft 50 in an axial direction. In the illustrative embodiment, the lugs 51, 52 are spaced apart from one another along the output shaft 50 in the circumferential and axial directions. Additionally, in the illustrative embodiment, the aft lug 51 is arranged circumferentially opposite the forward lug 52 around the output shaft 50, as best seen in FIG. 6.

The impactor 28 illustratively includes a carrier 30, an aft hammer 31, and a forward hammer 32, as shown in FIGS. 3 and 4. The carrier 30 is illustratively coupled to the motor shaft 40 and is driven by the motor shaft 40 about the output axis 42 (and, in the illustrative embodiment, the motor axis 41). The aft hammer 31 is coupled to the carrier 30 by a pin 56 for rotation relative to the carrier 30 about an aft hammer axis 61. The forward hammer 32 is coupled to the carrier 30 by a pin 58 for rotation relative to the carrier 30 about a forward hammer axis 62 as suggested in FIG. 3.

In the illustrative embodiment, each hammer 31, 32 is hollow and extends around the anvil 26 as shown in FIGS. 2 and 3. The aft hammer 31 includes an outer ring 64 and a pair of impact jaws 65, 66 that extend inward in the radial direction from the outer ring 64 as shown in FIG. 4. Similarly, the forward hammer 32 includes an outer ring 67 and a pair of impact jaws 68, 69 that extend inward in the radial direction from the outer ring 67. The outer ring 64 of the aft hammer 31 extends around the output shaft 50 and the aft lug 51 of the anvil 26 so that the impact jaws 65, 66 of the aft hammer 31 are configured to impart repeated blows onto the aft lug 51 during rotation of the carrier 30. The outer ring 67 of the forward hammer 32 extends around the output shaft 50 and the forward lug 52 of the anvil 26 so that the impact jaws 68, 69 of the forward hammer 32 are configured to impart repeated blows onto the forward lug 52 during rotation of the carrier 30.

The aft hammer 31 is formed to include a first notch 71 and a second notch 72 each extending inward in the radial direction into the outer ring 64 as shown in FIG. 4. The first notch 71 is configured to receive the pin 56 so that the aft hammer 31 pivots about the pin 56 relative to the carrier 30. The second notch 72 is arranged substantially opposite the first notch 71 and is configured to receive the pin 58 and to allow movement of the aft hammer 31 relative to the pin 58 during rotation of the aft hammer 31 relative to the carrier 30.

The forward hammer 32 is similar to the aft hammer 31 and is formed to include a first notch 73 and a second notch 74 each extending inward in the radial direction into the outer ring 67 as shown in FIG. 4. The first notch 73 is configured to receive the pin 58 so that the forward hammer 32 pivots about the pin 58 relative to the carrier 30. The second notch 74 is arranged substantially opposite the first notch 73 and is configured to receive the pin 56 and to allow movement of the forward hammer 32 relative to the pin 56 during rotation of the forward hammer 32 relative to the carrier 30. Additional description of the operation of the hammers 31, 32 included in the impactor 28 is described in U.S. Pat. No. 4,287,956, the entirety of which is incorporated herein by reference.

Turning specifically to FIG. 6, the lugs 51, 52 are shown to extend different distances circumferentially around the output shaft 50. More particularly, in the illustrative embodiment, the aft lug 51 extends further around the output shaft 50 circumferentially than the forward lug 52. In other words, the aft lug 51 extends around the output shaft 50 through an angle $\alpha$, while the forward lug 52 extends around the output shaft 50 through an angle $\beta$ that is smaller than the angle $\alpha$. In the illustrative embodiment, the aft lug 51 extends further around the output shaft 50 than the forward lug 52 in both the clockwise and counterclockwise direction, since the illustrative drive train 20 is adapted for both clockwise and counterclockwise rotation to both tighten and loosen fasteners.

Sizing of the aft lug 51 to extend further around the output shaft 50 than the forward lug 52 promotes even loading of the lugs 51, 52 when torque is applied to the anvil 26 during operation of the impact tool 10. In other words, this unequal sizing of the aft lug 51 and the forward lug 52 may reduce or eliminate uneven loading that would otherwise occur due to torsional windup of the anvil 26 during high torque operation of an impact tool 10. By evenly loading the lugs 51, 52 of the anvil 26, the life of the anvil 26 may be extended, with a need for additional and/or strengthened materials.

Turning now to FIGS. 7-10, another illustrative embodiment of an anvil 126 and an impactor 128 that may be used in the drive train 20 of the impact tool 10 is shown. Except as noted below, the anvil 126 and the impactor 128 may be generally similar to the anvil 26 and the impactor 28 described above and shown in FIGS. 1-6. Accordingly, similar reference numbers in the 100 series indicate features that are similar between the anvil 26/impactor 28 and the anvil 126/impactor 128.

Figure 8:
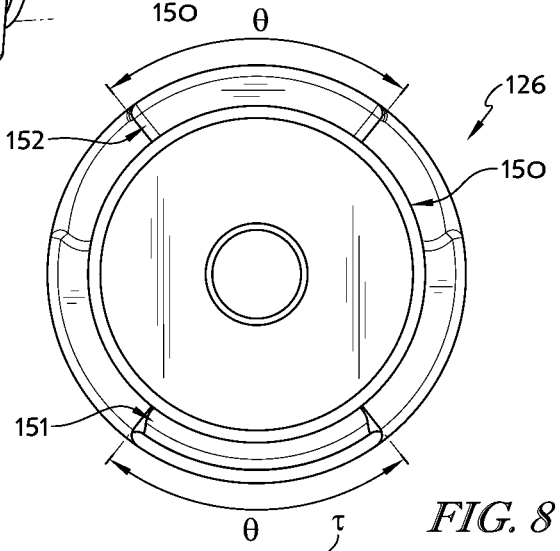
FIG. 8 is an aft end view of the anvil of FIG. 7.

Unlike anvil 26, the anvil 126 includes an aft lug 151 and a forward lug 152 that both extend the same distance around an output shaft 150 included in the anvil 126, as best seen in FIG. 8. In other words, the lugs 151, 152 both extend around the output shaft 150 through equal angles $\theta$. While the lugs 151, 152 are equally sized, hammers 131, 132 of the impactor 128 are differently sized, so as to evenly load the lugs 151, 152 during operation of an impact tool 10 incorporating the anvil 126 and the impactor 128.

Figure 9:
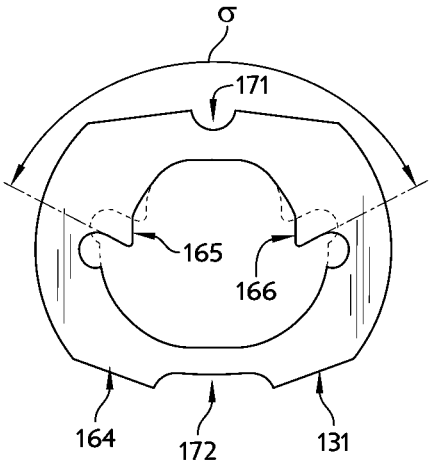
FIG. 9 is an end view of the aft hammer of FIG. 7.
Figure 10:
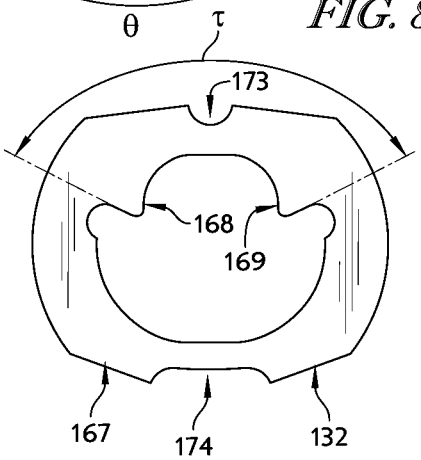
FIG. 10 is an end view of the forward hammer of FIG. 7.

In the illustrative embodiment of FIGS. 7-10, the impact jaws 165, 166 of the aft hammer 131 are spaced differently than the impact jaws 168, 169 of the forward hammer 132, as shown in FIGS. 9 and 10. More specifically, the impact jaws 165, 166 are spaced further circumferentially around the outer ring 164 of the aft hammer 131 than the impact jaws 168, 169 are spaced around the outer ring 167 of the forward hammer 132, as indicated by angle $\sigma$ (corresponding to aft hammer 131) and angle $\tau$ (corresponding to the forward hammer 132). For comparison, a phantom outline of the forward hammer 132 is superimposed on the aft hammer 131 in FIG. 9. This different sizing of the hammers 131, 132 promotes even loading of the lugs 151, 152 when torque is applied to the anvil 126 during operation of an impact tool 10 including the anvil 126 and the impactor 128.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A rotary impact tool comprising:

a motor including a rotor and an input shaft coupled to the rotor for rotation therewith about an input axis;

an anvil configured to be rotated about an output axis, the anvil including an output shaft, wherein the anvil has a cylindrical body forming a circumferential surface defining a radial periphery of the anvil; a first lug extending outward from the circumferential surface in a first radial direction and distance from the output shaft and extending a first circumferential distance around the output shaft in a circumferential direction, and a second lug extending outward from the circumferential surface in a second radial direction and distance from the output shaft, wherein the second radial distance is substantially the same as the first radial distance; wherein the second lug extending a second circumferential distance that is different from the first circumferential distance around the output shaft in the circumferential direction; and wherein the first radial distance and the second radial distance are located beyond the radial periphery of the anvil; and a first hammer driven by the input shaft and configured to impact the anvil to cause the anvil to rotate about the output axis.

2. The rotary impact tool of claim 1, wherein the input shaft axis and the output shaft axis are collinear.

3. The rotary impact tool of claim 1, wherein the input shaft axis and the output shaft axis are non-parallel.

4. The rotary impact tool of claim 1, wherein:

the output shaft has a proximal end and a distal end spaced apart from the proximal end, the distal end being adapted to be coupled to a fastener driver; and the first lug is spaced further from the proximal end than the second lug.

5. The rotary impact tool of claim 4, wherein the second lug extends further around the output shaft in the circumferential direction than the first lug.

6. The rotary impact tool of claim 5, wherein the first lug is spaced apart from the second lug around the output shaft in the circumferential direction.

7. The rotary impact tool of claim 5, wherein the first lug is arranged circumferentially opposite the second lug around the output shaft.

8. The rotary impact tool of claim 5, wherein the first lug and the second lug extend substantially the same distance along the output axis.

9. The rotary impact tool of claim 1, further comprising a second hammer driven by the input shaft and configured to impact the anvil to cause the anvil to rotate about the output axis.

10. The rotary impact tool of claim 9, wherein:

the first hammer extends around the output shaft and the first lug; and the second hammer extends around the output shaft and the second lug.

11. The rotary impact tool of claim 9, further comprising a carrier coupled to the input shaft for rotation therewith, wherein:

the first hammer is coupled to the carrier for rotation relative to the carrier about a first hammer axis spaced apart from the output axis; and the second hammer is coupled to the carrier for rotation relative to the carrier about a second hammer axis spaced apart from the output axis and the first hammer axis.

* * * * *